US005813422A

United States Patent [19]

Beck

[11] Patent Number: 5,813,422

[45] Date of Patent: Sep. 29, 1998

[54] CLEANING DEVICE FOR AN EMISSION

[76] Inventor: Kenneth G. Beck, 80 E. Surrey La., Barrington Hills, Ill. 60010

[21] Appl. No.: 596,474

[22] Filed: Feb. 5, 1996

[51] Int. Cl.[6] ..... B08B 3/04; B08B 9/00

[52] U.S. Cl. ..... 134/111; 134/169 R; 134/169 A

[58] Field of Search ..... 134/111, 169 R, 134/169 A

[56] References Cited

U.S. PATENT DOCUMENTS

| | | | |
|---|---|---|---|
| 2,222,516 | 11/1940 | Powell et al. | 134/169 A X |
| 2,665,772 | 1/1954 | Greer et al. | 134/169 A X |
| 3,182,670 | 5/1965 | Howell | 134/169 R X |
| 3,531,323 | 9/1970 | Carpenter | 134/169 R X |
| 4,895,603 | 1/1990 | Semp et al. | 134/169 R X |

*Primary Examiner*—Philip R. Coe
*Attorney, Agent, or Firm*—Mathew R. P. Perrone, Jr.

[57] ABSTRACT

A method and a device for cleaning an emission testing apparatus, which uses a low volume solenoid structure causes a fluid to flow through the emission testing apparatus, to serve a cleaning function thereof.

12 Claims, 2 Drawing Sheets

100
110
114
116
120
122
124
126
128
130
132
134
136
138
140
200
202
204
206
208
210
212
214
216
220
222
224
226
228
230
232
234
240
242
244
246
248
250
252
254
256
260
268
270
272
184
A
B
NO
NO
V1
V2
V3
FB A
FB B
+
-

100
110
114
116
120
122
124
126
128
130
132
134
136
138
140
200
202
204
206
208
210
212
214
216
220
222
224
226
228
230
232
234
240
242
244
246
248
250
252
254
256
260
268
270
272
186
A
B
NO
V1
V2
V3
FB A
FB B

CLEANING DEVICE FOR AN EMISSION

TESTING APPARATUS AND METHOD

This invention relates to a cleaning device for an emission testing apparatus and more particularly to a cleaning device for an emission testing apparatus for cleaning a low volume solenoid used in an emission testing apparatus.

BACKGROUND OF THE INVENTION

The control of pollution in the environment is extremely important. Environmental problems create great health risks and severely decrease the quality of life. A primary source of material for such pollution and this decrease in this quality of life is the use of combustion engines, such engines used in vehicles. A typical vehicle is an automobile, which can greatly add to pollution.

In order to reduce pollution, it is common to test a vehicle for pollution emission. If such testing can occur in an extremely efficient manner, great advantages can result. Tremendous amounts of time and resources are expended in such testing. Time is spent by the vehicle owner in having a vehicle tested. Time is spent by the testing operator in running the test.

A common problem with an emission testing apparatus is fouling of a low volume solenoid therein. Such fouling occurs because of particles created or inherently present in the emission testing system. If such fouling can be avoided, great advantages result. The emissions program obtains a more accurate test. The emission testing apparatus is run more efficiently.

It is desirable to accurately test an engine and minimize damage to an emission testing apparatus. This factor is very important to low volume solenoid contained therein.

However, a low volume solenoid has a rather small cross section for the part, through which the emissions must pass. Each low volume solenoid can acquire a deposit from burned or unburned fuel present in the emissions. This deposit restricts the area for emissions to pass through the solenoid and interferes with the proper operation of the solenoid.

This modification of the solenoid caused by this deposit is harmful to the solenoid in particular, and the emission testing apparatus in general. Such a deposit is especially a problem for those solenoids, and the device for operating the same.

Among the many attempts to keep the low volume solenoids clean is use additives in the cleaning solution. To physically remove and take apart the emission testing apparatus and the low volume solenoid to achieve the cleaning is an extremely expensive and time consuming operation. These problems are hard to trouble shoot and can lead to putting in expensive components to find what was missed in trouble shooting at the customers cost.

While, many cleaning devices for low volume solenoids are known, no device efficiently overcomes the debris and particle problem created in the system. As the low volume solenoid is cleaned, the deposit breaks down into debris and particles; which, in turn, cause a malfunction in at least the low volume solenoid, if not the emission testing system being cleaned.

If a device can be developed to clean a low volume solenoid, in place, on an emissions testing apparatus, great advantages will be obtained. It is very desirable to develop a procedure, which can clean the emissions testing apparatus very efficiently, without disassembly of the apparatus or adverse effects of cleaning agents.

SUMMARY OF THE INVENTION

Among the many objectives of this invention is the provision of a method and a device to clean a low volume solenoid of an emission testing apparatus in place.

Another objective of this invention is to provide a device to reduce deposits in a low volume solenoid.

Yet another objective of this invention is to provide a method of removing deposits from a low volume solenoid of an emission testing apparatus.

Still another objective of this invention is to provide a method to reduce deposits in a low volume solenoid of an emission testing apparatus.

Additionally, an objective of this invention is to provide a method for cleaning a low volume solenoid of an emission testing apparatus, without disassembling the solenoid.

These and other objectives of the invention (which other objectives become clear by consideration of the specification, claims and drawings as a whole) are met by providing a method and a device for cleaning an emission testing apparatus, which uses a low volume solenoid structure.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
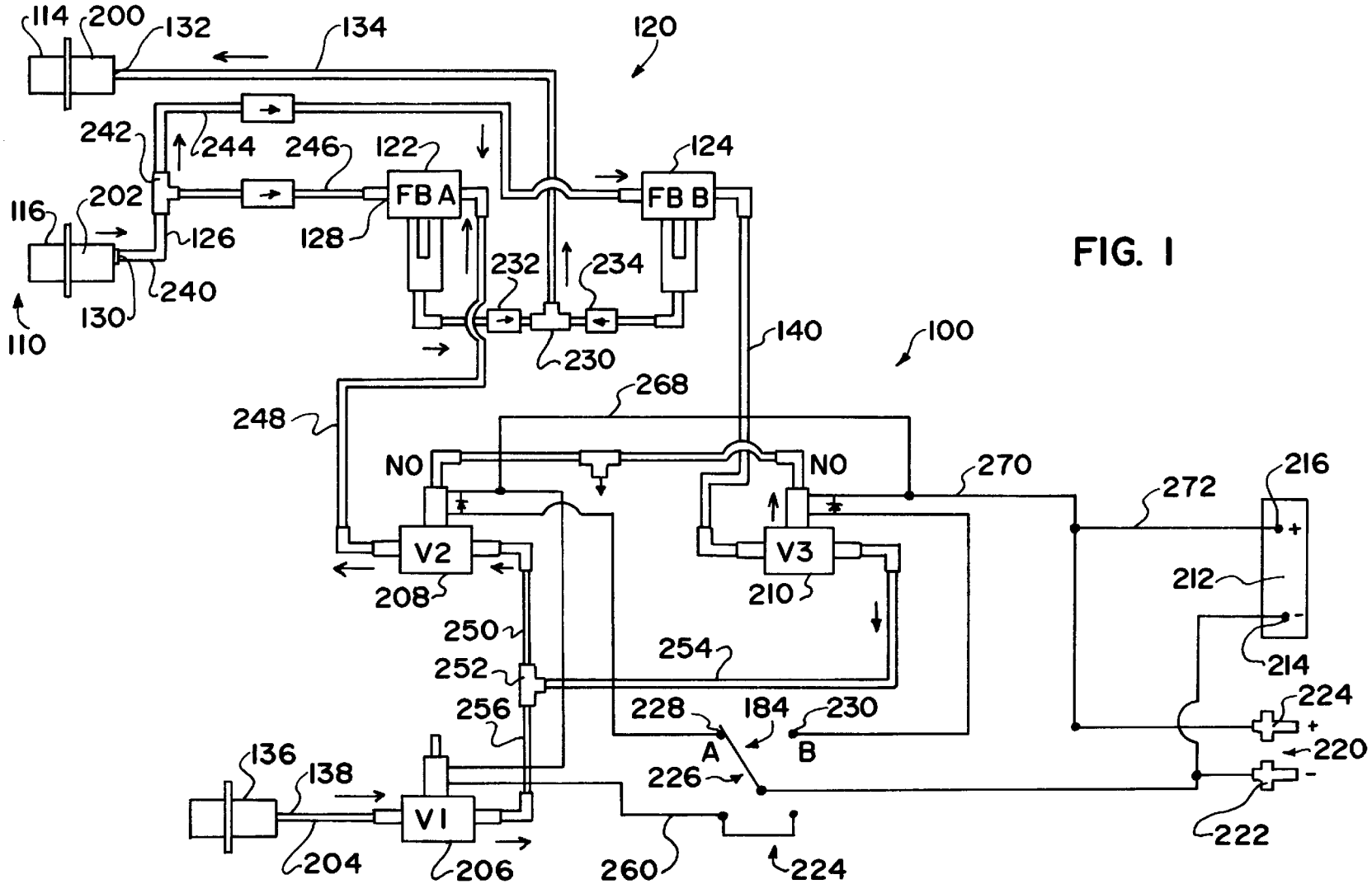
FIG. 1 depicts a circuit diagram 120 of the clean in place system 100 of this invention suitable for cleaning an emission testing apparatus 110, in pressure position 180.

The clean in place system for an emission testing apparatus, in general, and low volume solenoid ports used therein in particular, includes a pair of interconnected filter bowls, which are jointly connected to a pump. A pressure source, caused by a vacuum or an air pressure, as desired, is connected to the pump input of the clean in place system. A power source is connected to the pressure source of the system.

The interconnected filter bowls include a first filter bowl and a second filter bowl. The filter bowl is selected based on the choice of air pressure or vacuum pressure. Tubing, preferably clear polymer tubing, is looped to both the exhaust port and the intake port of the emissions apparatus. More particularly, the exhaust port is connected to the first filter bowl, while the intake port is connected to the second filter bowl.

A switch is set on an appropriate position to direct the fluid flow, depending on whether pressure or vacuum power is used, and on which filter bowl is desired to be used and then the pump is operated. A movement of the switch reverses the fluid flow through the low volume solenoids and provides for more efficient cleaning. The pump of course may be a hand vacuum pump or a power pump as desired.

Pressure and vacuum are the reverse forces. By vacuum is meant a pressure less than atmospheric pressure. By pressure is meant a pressure greater than atmospheric pressure. Either force may drive the cleaning fluid as desired. In fact both forces may be used alternatively in the cleaning process.

The cleaning fluid (preferably water with a cleaning agent) empties from one filter bowl into the other filter bowl from inside the filter element, and fills the opposing filter bowl. Then the switch is to a position as determined by the vacuum or the air pressure, and the pump is operated to circulate the fluid through the low volume solenoids of the emission testing system for a vehicle.

While any fluid and cleansing agent are operable to form a cleaning solution for use with the clean in place system, the preferred fluid is distilled water. The preferred cleansing agent is a suitable liquid. This suitable liquid is most preferably a liquid detergent suitable for use in an automatic dishwasher.

The concentration of the cleaning agent in water is up to about five (5%) by weight of cleaning fluid. More preferably, the concentration of the cleaning agent is about one-hundredth (0.01%) percent to about four and one-half (4.5%) by weight of cleaning fluid. Most preferably, the concentration of the cleaning agent is about one-tenth (0.1%) percent to two and one-half (2.5%) by weight of cleaning fluid.

This clean in place system for an emission testing system overcomes the problem of debris and particle causing malfunction in a low volume solenoid configuration for cleaning. This system works with an external volt direct current power supply in a pressure or vacuum adequate to transfer fluids through the system being cleaned. It is definitely possible to use the vehicle battery itself to power this system.

While any power source is suitable for operating the device of this invention, it is possible to use a twelve volt power source, such as the vehicle battery itself. In particular, a twelve volt battery or other twelve volt power source may be used. This suggested power source is based on ease of use, access to a power source, and convenience of setting up the system.

If a pressure or vacuum source is not available, a hand vacuum pump may be used for pulling the solution through the system being cleaned. It is preferred, however, to use the pressure source or the vacuum source. The pressure source can produce a positive pressure, thereby driving fluid through the emissions testing device for cleaning. The vacuum can produce a negative pressure, thereby pulling through the emissions testing device for cleaning.

In operation, a vacuum source is connected to the pump input of the clean in place system. The power source is connected to the jacks of the system. The jacks of the system are thus provide a connection for the system to the power source.

A first filter bowl is filled with water and cleaning agent. Tubing, preferably clear polymer tubing, is looped from the first filter bowl to the exhaust and intake ports of the emission apparatus. Tubing is also looped from the first filter bowl to the exhaust and intake ports of the emission apparatus.

A switch is set on an appropriate position, depending on which filter bowl it is desired to use, and then the pump is operated. The pump, of course, may be a hand vacuum pump or a power pump as desired. The cleaning fluid (preferably water and a cleaning agent) will empty out of one fluid bowl into the other fluid bowl from inside the filter element and fill the filter bowl. Then the switch is applied to position A or B as desired and the pump is operated.

The pump operation vacuum operation is the opposite of the pressure operation, with regard to air flow. The same cleaning results are obtained. The switch is placed in the off or vent position while the hand pump is operated. Air then should then exhaust from the vent of the first solenoid. The fluid should always be transferred from exhaust to intake.

Preferably of course the clean in place system is powered by a twelve volt direct current source to energize the three solenoids. The solenoids operate the flow direction through the clean in place system. The system maybe hooked up to an existing twelve volt direct current source in the unit being cleaned. If such a source is not available, it can be hooked up to a battery or other direct current power source using the supplied jacks.

Usually, the jacks indicate positive voltage at red, and negative voltage or ground at black. It is also possible to use direct current provided there is a convertor device producing the direct current. The advantages of using the universal connector is that it allows the banana jacks or other attaching means to connect the heads of the solenoid valves being cleaned for proper operation.

To insert the cleaning solution, the first filter is removed if pressure for the pump input is going to be used. If a vacuum is going to be used, the second filter is removed leaving the filter on the bottom of the filter bowl connected. Either way it is worked, the filter bowl is filled to about seventy-five (75%) percent with water and a small amount of cleaning solution such as a liquid automatic dish washing detergent. The resulting solution is stirred until mixed.

The filter bowl is then re-installed. After that step, the pump input is connected. This is accomplished by putting the operating switch in the off or vent position. A tube, preferably clear polymer tubing, is connected to the pump inlet on the face of the clean in place system in a fashion long enough to reach the pressure of vacuum being used as a pump source.

The intake and the exhaust are connected by removing the tubing that is looped from the exhaust to the intake from the intake especially at the intake nipple and connecting it to a common port on the solenoid configuration, that is to be cleaned. Another piece of tubing is connected to the intake nipple and the other end to the ports of the solenoid valve to be cleaned. T-fittings are used where more than one port is provided.

Once the power exhausted intake is connected, a second check must be made to avoid unwarranted escape of cleaning solution. With the pressure source, the switch is put in the first position and the cleaning of the system may be observed. It is important to determine whether leaks exist or if the cleaning solution is going in an improper fashion. Once the solution is all in the second filter bowl, the switch is set to the second position and reverses the switch cycle. This change is repeated until the system is cleaned.

If the system being cleaned is configured in different ways, it is possible to change the configuration manually or by software. The switch is left in the A or B position, and all configurations are used to return most of the cleaning solution. The repeat of this procedure permits not only cleaning of the solenoid, but recovery and recycling or proper disposal of the cleaning solution.

After the system is cleaned, the switch is moved to the off or vent status, the pump supply is disconnected and the power to the clean in place system is removed. The system is dried by clean air or vacuum and reconnected. The emission testing apparatus is now suitable for use.

While it is not desired to be bound by any particular theory, the following is the assumed reason for the cleaning using pressure as the pump source. If a vacuum source is used, the switches are reversed. In operation, when the switch is in the off or vent position, pressure is directed to the pump input of the clean in place system and into the common port of the first solenoid valve. From that position, the cleaning solution goes out of the solenoid and into the ports for cleaning. The reversal of flow causes the complete cleaning of the low volume solenoid ports.

Referring now to FIG. 1, the clean in place system 100 of this invention is secured to an emission testing apparatus 110. The emission testing apparatus 110 has an exhaust port 114 and an intake port 116 to which the clean in place system 100 is attached. The exhaust port 114 is attached to solenoid output 200. The intake port 116 is attached to solenoid intake 202.

Figure 2:
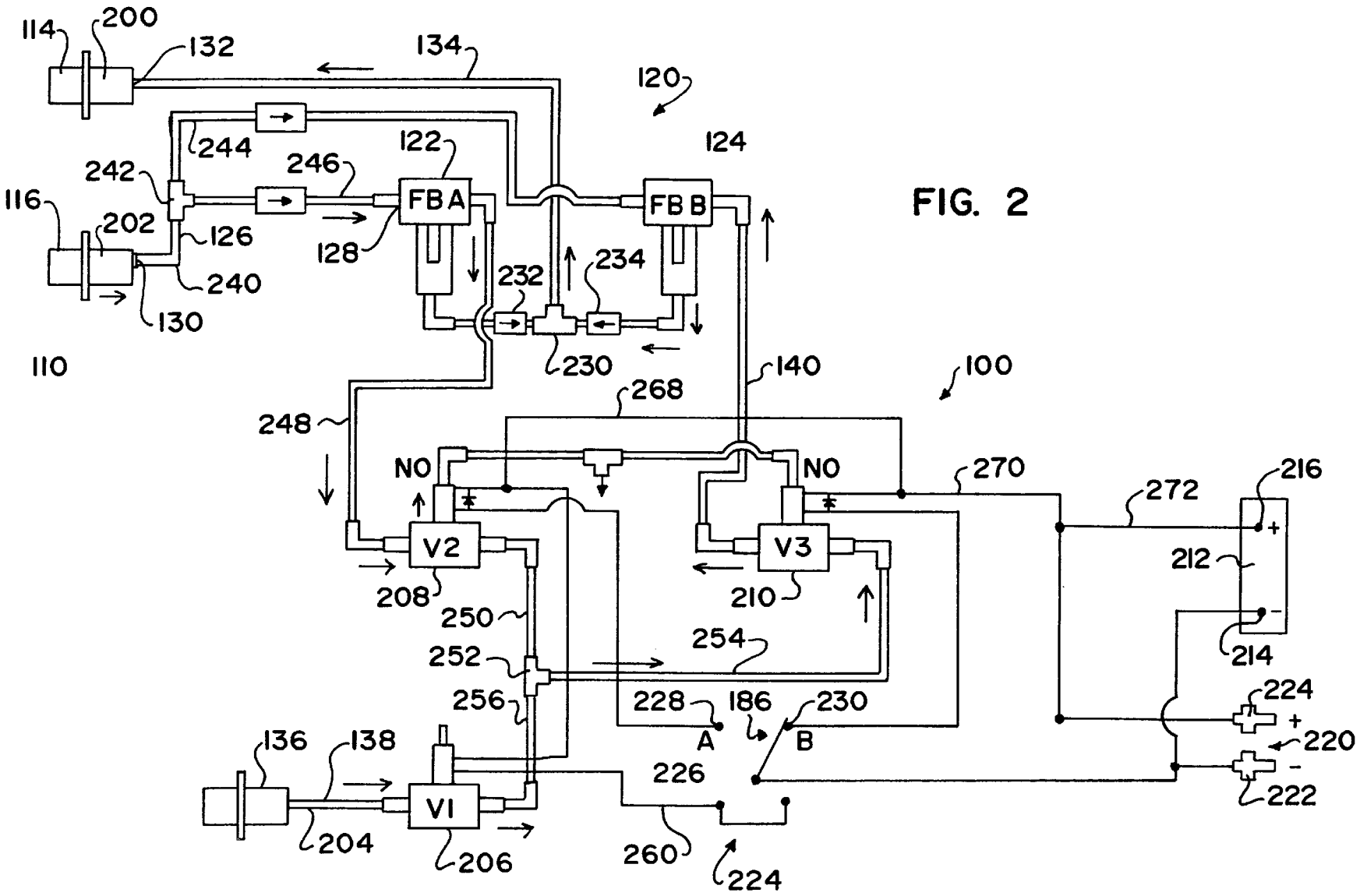
FIG. 2 depicts a circuit diagram 120 of the clean in place system 100 of this invention suitable for cleaning an emission testing apparatus 110, in vacuum position 200.

Referring now to FIG. 2, the solenoid output 200 and the solenoid intake 202 are both connected to the first filter bowl 122 and the second filter bowl 124. Pump 204, whether it is a vacuum source or an air pressure source, is connected to the first solenoid 206. The first solenoid 206 is connected to the second solenoid 208 and to the first filter bowl 122. The flow direction switch 226 directs the flow of cleaning fluid through the various ports of the solenoids. It has a first direction position 228 is and a second direction position 230. First direction position 228 is used in the first filter bowl 122. Second direction position 230 is used in the second filter bowl 124.

The solenoid interconnections are accomplished in any suitable standard fashion. First solenoid 206 is also connected to the second solenoid 208. Additionally second solenoid 208 is connected to the third solenoid 210. First solenoid 206 is also connected to third solenoid 210.

The universal connector 212 provides a simplified connection of the clean in place system 100 to the emission testing apparatus 110. It has a negative post 214 and positive post 216. The power source 220 has a negative post 222 and a positive post 224. Power source 220 is connected to this third solenoid 210 and to the first solenoid 206. The universal connector 212 is connected to the power switch 224 and to the third solenoid 210. The power switch 224, of course, is connected to the flow director 226. The switch 224 is connected to the flow director 226.

Referring back to FIG. 1 to the consideration, the clean in place system 100 is shown as a circuit diagram 120. It includes a first filter bowl 122 and a second filter bowl 124. Throughout clean in place system 100, connections between parts thereof are made by tubing 126, which slips onto an appropriate nipple connector 128. Tubing 126 may be secured to nipple connector 128 by friction or a nipple clamp 130.

First filter bowl 122 may be connected at one point to exhaust port 114. Second filter bowl 124 is then connected at one point to intake port 116. Such connections may also be reversed if desired. This structure is described for convenience, however.

Adding FIG. 2 back to the consideration, the clean in place system 100 includes a first filter bowl 122, which may be connected at one point to exhaust port 114. Second filter bowl 124 is then connected at one point to intake port 116. Such connections may also be reversed if desired. This structure is described for convenience, however.

More particularly, first filter bowl 122 includes port nipple 132. Exhaust tube 134 runs from port nipple 132 to exhaust port 114, and is connected at each end thereof in appropriately standard fashion. In a like manner, intake tube runs from second filter bowl 124 to intake port 116. To reemphasize, such connections may also be reversed if desired.

First filter bowl 122 is connected to a pump 136 by first pump tube 138 in a standard fashion. Likewise, second filter bowl 124 is connected to pump 136 by second pump tube 140 in a standard fashion. Clearly, pump 136 can create a vacuum or provide air pressure in order to force cleaning fluid through the low volume solenoid system of emission testing system 110.

Exhaust tube 134 is connected at the first end to the solenoid output 200 and the second end to a first tee connector 230. Tee connector 230 has three connecting points. The first tee connector 230 is connected, at a first of those three connecting points, by a first filter bowl tube 232 to first filter bowl 122. At the second point, a second filter bowl tube 234 connects first tee connector 230 to second filter bowl 124.

Running from solenoid intake 202 is an intake tube 240, which is connected to a second tee connector 242. Second tee connector 242 is connected to second filter bowl tube 244 and also connected to first filter bowl tube 246. From first filter bowl 232, also runs a second solenoid tube 248 down to second solenoid 208. From second solenoid 208, runs a solenoid tube connector 250 to a third tee connector 252. Third tee connector 252 is connected by second solenoid tube 254 to third solenoid 210 and by third solenoid tube 256 to first solenoid 206.

From power switch 224 is a wire to first solenoid 206 at a first connecting wire 260 to first solenoid 206. From first solenoid 206 is a solenoid wire 262 to second solenoid 208. From second solenoid 208 is a fourth wire 268 to third solenoid 210. Third solenoid 210 has fourth wire 268 connected to the first power wire 270. First power wire 270 runs from positive terminal 220 to third solenoid 210. Also connected to first power wire 270 by positive universal wire 272 is the positive universal post 216. The negative universal post 214 from universal connector 212 is connected to the flow director 226.

The flow director has this pressure position 184 and a vacuum position 186 for reversing the flow of cleaning fluid through the system. In particular, pressure position 184 and the flow of cleaning fluid caused thereby is depicted in FIG. 1. Clearly vacuum position 186 and the flow of cleaning fluid caused thereby is depicted in FIG. 2.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A device for cleaning an emission testing apparatus, the device being suitable for use with a low volume solenoid structure in the emission testing apparatus and being adapted to propel a cleaning fluid through the emission testing apparatus, the device comprising:

(a) a power source, a fluid flow direction means being connected to a fluid flow force means and the power source, and a connecting means for attaching the device to the emission testing apparatus at the fluid flow direction means;

(b) a filtering means being connected between the fluid flow force means and the fluid flow direction means;

(c) the fluid flow direction means further including a propelling means selected from the group consisting of a vacuum source and pressure source;

(d) the fluid flow direction means further including a pump;

(e) the propelling means being connected to the pump;

(f) the filtering means being connected to the pump;

(g) the propelling means being connected to the power source;

(h) the filtering means including a first filter bowl and a second filter bowl;

(i) the first filter bowl being used with a pressure source; and (j) the second filter bowl being used with a vacuum source.

2. The device for cleaning an emission testing apparatus of claim 1 further comprising:

(a) the emission testing apparatus including an exhaust port and an intake port;

(b) the intake port being connected to the second filter bowl; and (c) the exhaust port being connected to the first filter bowl.

3. The device for cleaning an emission testing apparatus of claim 2 further comprising:

(a) a switch means being connected to the device for determining whether the vacuum source or the pressure source is used; and (b) the switch means providing a direction for a fluid flow through the emission testing apparatus.

4. The device for cleaning an emission testing apparatus of claim 6 further comprising:

(a) the vacuum source directing the fluid flow in a first direction through the emission testing system;

(b) the pressure source directing the fluid flow in a second direction through the emission testing system;

(c) the first direction being substantially opposite to the second direction; and (d) the first direction combining with the second direction to provide a thorough cleaning of the emission testing system.

5. The device for cleaning an emission testing apparatus of claim 4 further comprising the propelling means including a direct current source.

6. The device for cleaning an emission testing apparatus of claim 5 further comprising the direct current source including a twelve volt source.

7. The device for cleaning an emission testing apparatus of claim 4 further comprising the propelling means including a manually operated source.

8. The device for cleaning an emission testing apparatus of claim 4 further comprising:

(a) the device including a pump input;

(b) the device including at least one power jack for attaching the propelling means to the device;

(c) the first filter bowl being filled with a liquid cleaning agent; and (d) the first filter bowl being connected to an exhaust port and an intake port of the emission testing apparatus.

9. The device for cleaning an emission testing apparatus of claim 8 further comprising:

(a) the liquid cleaning fluid being water and a cleaning agent; and (b) the cleaning agent comprising up to about five percent of the cleaning fluid.

10. The device for cleaning an emission testing apparatus of claim 9 further comprising the cleaning agent comprising about 0.1 percent to about 2.5 percent of the cleaning fluid.

11. The device for cleaning an emission testing apparatus of claim 9 further comprising the emission testing apparatus including a low volume solenoid structure.

12. The device for cleaning an emission testing apparatus of claim 9 further comprising;

(a) a switch for operating the device;

(b) the switch further including a pressure position, a vacuum position and an off position; and (c) the switch being adaptable to provide the pressure position, the vacuum position and the off position, as desired.

* * * * *